US008477073B2

(12) United States Patent
Kim

(10) Patent No.: US 8,477,073 B2
(45) Date of Patent: Jul. 2, 2013

(54) INTERNAL WIDE BAND ANTENNA USING SLOW WAVE STRUCTURE

(75) Inventor: Byong-Nam Kim, Kyeonggi-do (KR)

(73) Assignee: Ace Technologies Corporation, Incheon-si (KR)

( * ) Notice: Subject to any disclaimer, the term of this patent is extended or adjusted under 35 U.S.C. 154(b) by 260 days.

(21) Appl. No.: 12/989,928

(22) PCT Filed: Mar. 30, 2009

(86) PCT No.: PCT/KR2009/001609
§ 371 (c)(1),
(2), (4) Date: Oct. 27, 2010

(87) PCT Pub. No.: WO2009/134013
PCT Pub. Date: Nov. 5, 2009

(65) Prior Publication Data

US 2011/0043412 A1 Feb. 24, 2011

(30) Foreign Application Priority Data

Apr. 30, 2008 (KR) ..... 10-2008-0040878

(51) Int. Cl.
*H01Q 1/24* (2006.01)

(52) U.S. Cl.
USPC ..... 343/702; 343/700 MS

(58) Field of Classification Search
USPC ..... 343/702, 700 MS
See application file for complete search history.

(56) References Cited

U.S. PATENT DOCUMENTS

| | | | | |
|---|---|---|---|---|
| 5,986,620 | A | 11/1999 | Filipovic | |
| 6,677,905 | B2 * | 1/2004 | Deguchi et al. | 343/702 |
| 6,801,169 | B1 * | 10/2004 | Chang et al. | 343/700 MS |
| 6,864,845 | B2 | 3/2005 | Kuo et al. | |
| 7,218,282 | B2 * | 5/2007 | Humpfer et al. | 343/700 MS |
| 2003/0016177 | A1 | 1/2003 | Deguchi et al. | |
| 2003/0174092 | A1 | 9/2003 | Sullivan et al. | |

FOREIGN PATENT DOCUMENTS

| | | | |
|---|---|---|---|
| KR | 10-0715220 | A | 4/2007 |
| WO | 2007126897 | A2 | 11/2007 |
| WO | 2007126897 | A3 | 11/2007 |
| WO | WO2007/126897 | A | 11/2007 |

OTHER PUBLICATIONS

International search report from PCT/KR2009/001609 completed on Nov. 12, 2009.

* cited by examiner

*Primary Examiner* — Hoang V Nguyen
(74) *Attorney, Agent, or Firm* — Duane Morris LLP

(57) ABSTRACT

Disclosed is a wide-band internal antenna that uses a slow-wave structure. The antenna includes an impedance matching/power feed part, which includes a first conductive element that extends from a power feed line and a second conductive element that is separated by a particular distance from the first conductive element and is electrically connected with a ground, and at least one radiator extending from the impedance matching/power feed part. Here, the first conductive element and the second conductive element of the impedance matching/power feed part form a slow-wave structure. By applying a slow-wave structure to coupling matching, the antenna provides the advantage of resolving the problem of narrow band characteristics found in inverted-F antennas while maintaining a low profile.

10 Claims, 10 Drawing Sheets

INTERNAL WIDE BAND ANTENNA USING SLOW WAVE STRUCTURE

TECHNICAL FIELD

The present invention relates to an antenna, more particularly to an internal antenna that provides impedance matching for a wide band.

BACKGROUND ART

In current mobile terminals, there is a demand not only for smaller sizes and lighter weight, but also for functions that allow a user access to mobile communication services of different frequency bands through a single terminal. That is, there is a demand for a terminal with which a user may simultaneously utilize signals of multiple bands as necessary, from among mobile communication services of various frequency bands, such as the CDMA service based on the 824~894 MHz band and the PCS service based on the 1750~1870 MHz band commercialized in Korea, the CDMA service based on the 832~925 MHz band commercialized in Japan, the PCS service based on the 1850~1990 MHz commercialized in the United States, the GSM service based on the 880~960 MHz band commercialized in Europe and China, and the DCS service based on the 1710~1880 MHz band commercialized in parts of Europe. Accordingly, there is a demand for an antenna having wide band characteristics to accommodate these multiple bands.

Furthermore, there is a demand for a composite terminal that allows the use of services such as Bluetooth, ZigBee, wireless LAN, GPS, etc. In this type of terminal for using services of multiple bands, an antenna having wide band characteristics is needed. The antennas generally used in mobile terminals include the helical antenna and the planar inverted-F antenna (PIFA).

Here, the helical antenna is an external antenna that is secured to an upper end of a terminal, and is used together with a monopole antenna. In an arrangement in which a helical antenna and a monopole antenna are used together, extending the antenna from the main body of the terminal allows the antenna to operate as a monopole antenna, while retracting the antenna allows the antenna to operate as a $\lambda/4$ helical antenna. While this type of antenna has the advantage of high gain, its non-directivity results in undesirable SAR characteristics, which form the criteria for levels of electromagnetic radiation hazardous to the human body. Also, since the helical antenna protrudes outwards from the terminal, it is difficult to design the exterior of the terminal to be aesthetically pleasing and suitable for carrying, but a built-in structure for the helical antenna has not yet been researched.

The inverted-F antenna is an antenna designed to have a low profile structure in order to overcome such drawbacks. The inverted-F antenna has directivity, and when current induction to the radiating part generates beams, a beam flux directed toward the ground surface may be re-induced to attenuate another beam flux directed toward the human body, thereby improving SAR characteristics as well as enhancing beam intensity induced to the radiation part. Also, the inverted-F antenna operates as a rectangular micro-strip antenna, in which the length of a rectangular plate-shaped radiating part is reduced in half, whereby a low profile structure may be realized.

Because the inverted-F antenna has directive radiation characteristics, so that the intensity of beams directed toward the human body may be attenuated and the intensity of beams directed away from the human body may be intensified, a higher absorption rate of electromagnetic radiation can be obtained, compared to the helical antenna. However, the inverted-F antenna may have a narrow frequency bandwidth when it is designed to operate in multiple bands.

The narrow frequency bandwidth obtained with the inverted-F antenna, in cases where the antenna is designed to operate in multiple bands, is resultant of point matching, in which matching with a radiator occurs at a particular point.

Thus, in order to enable operation in a wide band with greater stability, there is a need for an antenna that has a low profile structure and also overcomes the problem of narrow band characteristics found in typical inverted-F antennas.

DISCLOSURE

Technical Problem

To resolve the problems in prior art described above, an objective of the present invention is to provide an internal antenna that can provide impedance matching for a wide band.

Another objective of the present invention is to provide a wide-band internal antenna having a low profile that is capable of resolving the problem of narrow band characteristics found in typical inverted-F antennas.

Additional objectives of the present invention will be obvious from the embodiments described below.

Technical Solution

To achieve the objectives above, an aspect of the present invention provides a wide-band internal antenna using a slow-wave structure. The antenna includes an impedance matching/power feed part, which includes a first conductive element that extends from a power feed line and a second conductive element that is separated by a particular distance from the first conductive element and is electrically connected with a ground, and at least one radiator extending from the impedance matching/power feed part. Here, the first conductive element and the second conductive element of the impedance matching/power feed part form a slow-wave structure.

In the impedance matching/power feed part forming the slow-wave structure, a multiple number of first coupling elements may protrude from the first conductive element, and a multiple number of second coupling elements may protrude from the second conductive element, with the first coupling elements and the second coupling elements protruding periodically to form a slow-wave structure.

The first coupling elements and second coupling elements can be formed as rectangular stubs.

The first coupling elements and the second coupling elements forming the slow-wave structure may be formed such that a high capacitance/low inductance structure and a low capacitance/high inductance structure are repeated.

A dielectric having high permittivity can be coupled to the impedance matching part.

An inductance value related to coupling matching may be adjusted by a width of the first conductive element and the second conductive element.

Another aspect of the present invention provides a wide-band internal antenna that includes: a first conductive element electrically coupled with a power feed part; a second conductive element electrically coupled with a ground and separated by a particular distance from the first conductive part; and at least one radiator extending from the second conductive element to radiate RF signals by coupling power feed. A traveling wave is generated in the first conductive element and the second conductive element, and a periodic slow-wave structure is formed for slowing a progression of the traveling wave.

The slow-wave structure can include rectangular stubs that protrude periodically from the first conductive element and the second conductive element.

The multiple number of stubs may be formed such that a high capacitance/low inductance structure and a low capacitance/high inductance structure are repeated.

Advantageous Effects

According to certain aspects of the present invention, a wide-band internal antenna can be provided that resolves the problem of narrow band characteristics found in inverted-F antennas and also has a low profile, by applying a slow-wave structure to coupling matching.

MODE FOR INVENTION

The wide-band internal antenna using a slow-wave structure according to certain embodiments of the present invention will be described below in more detail with reference to the accompanying drawings.

An aspect of the present invention provides an antenna, which, despite having a low profile structure, also enables impedance matching for a wide band, in contrast to typical inverted-F antennas. An embodiment of the present invention provides a wide-band impedance matching structure that is based on matching using coupling.

Before describing the wide-band impedance matching structure according to an embodiment of the present invention, the structure of impedance matching by coupling, which an embodiment of the present invention is based on, will first be described.

Figure 1:
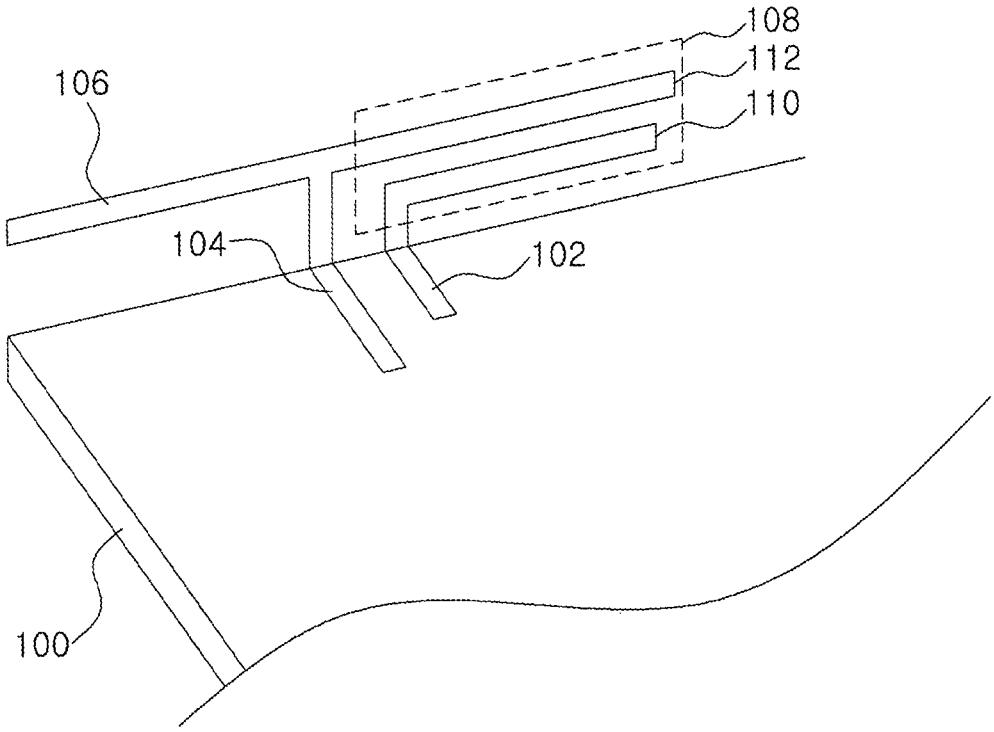
FIG. 1 illustrates the structure of an antenna that uses a matching structure based on coupling.

FIG. 1 illustrates the structure of an antenna that uses a matching structure based on coupling.

Referring to FIG. 1, an antenna using matching by coupling may include a board 100, a power feed line 102, a short-circuit line 104, a radiator 106, and an impedance matching part 108.

The power feed line 102 and the short-circuit line 104 may be coupled to the board 100, which can be made of a dielectric material. Various types of dielectric material can be applied for the board 100, such as a PCB or an FR4 board, etc.

The power feed line 102 may be electrically coupled with an RF signal transmission line formed on the board of the terminal, and may feed the RF signals.

The short-circuit line 104 may be electrically connected with the ground of the terminal's circuit board.

The radiator 106 may serve to radiate RF signals of preset frequency bands to the exterior and to receive RF signals of preset frequency bands from the exterior. The radiation band may be set according to the length of the radiator 106. The radiator may be electrically connected with the short-circuit line 104 and may be fed by coupling.

The impedance matching part 108 based on coupling may include a first conductive element 110 that extends from the power feed line 102 and a second conductive element 112 that extends from the short-circuit line 104.

The first conductive element 110 extending from the power feed line 102 and the second conductive element 112 extending from the short-circuit line 104 may be arranged parallel to each other with a particular distance in-between. A coupling phenomenon may occur between the first conductive element 110 and second conductive element 112, due to the interaction between the first and second conductive elements 110, 112, and impedance matching may be performed by way of this coupling phenomenon.

In this type of impedance matching based on coupling, the coupling matching may be achieved according to the capacitance and inductance components. Capacitance plays a more important role, and in cases where the impedance matching is to be obtained for an especially wide band, a high capacitance value may be required, and the region for providing coupling may have to be large.

If the first conductive element 110 and second conductive element 112 are formed as in the arrangement shown in FIG. 1, there may not be sufficient coupling provided, and the appropriate amount of radiation and wide-band matching may not be obtained.

Figure 2:
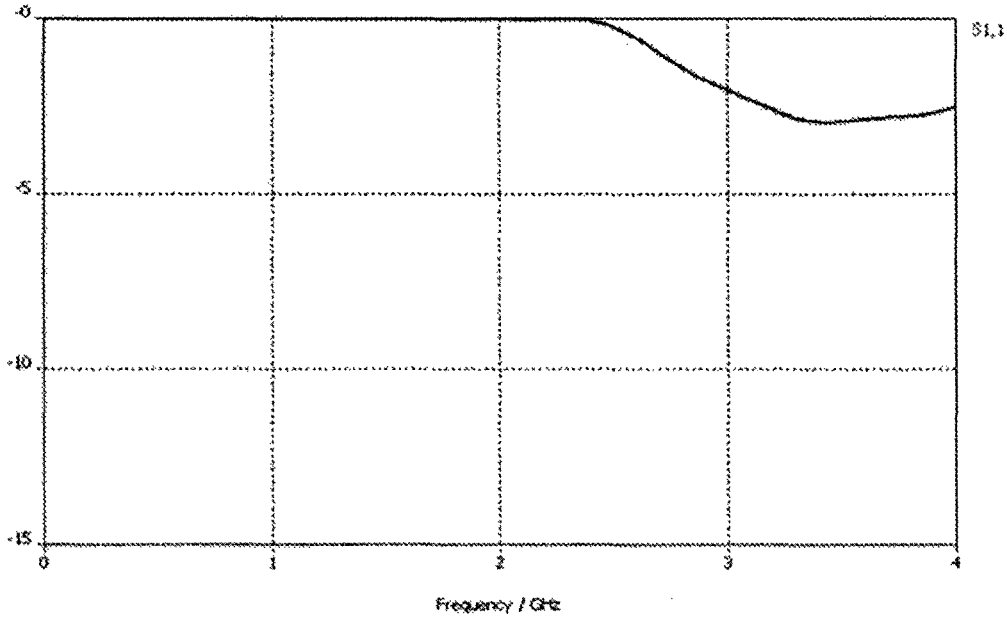
FIG. 2 is a graph representing the reflection loss for the antenna illustrated in FIG. 1.

FIG. 2 is a graph representing the reflection loss for the antenna illustrated in FIG. 1.

Referring to FIG. 2, it can be seen that there is not appropriate matching obtained for the S11 parameter. This is because the coupling is not obtained by a large capacitance component.

Korean patent application no. 2008-2266 proposed by the inventor discloses an antenna in which wide-band impedance matching is implemented by way of a structure that includes coupling elements protruding from a first conductive element and a second conductive element, with the coupling elements forming a generally comb-like arrangement.

This application teaches of implementing impedance matching for a wide band by using the coupling elements to substantially decrease the distance between the first conductive element and the second conductive element as well as to increase the actual electrical length of the impedance matching part, so that the capacitance component acting on the coupling can be increased and the coupling can be effected by various capacitance components.

In a wide-band antenna according to an embodiment of the present invention, the impedance matching for a wide band may be achieved by forming a slow-wave structure between the first conductive element and the second conductive element. The slow-wave structure formed between the first conductive element and the second conductive element according to an aspect of the invention makes it possible to provide radiation more efficiently compared to the coupling matching structure such as that shown in FIG. 1, and also makes it possible to provide impedance matching for a wide band.

Figure 3:
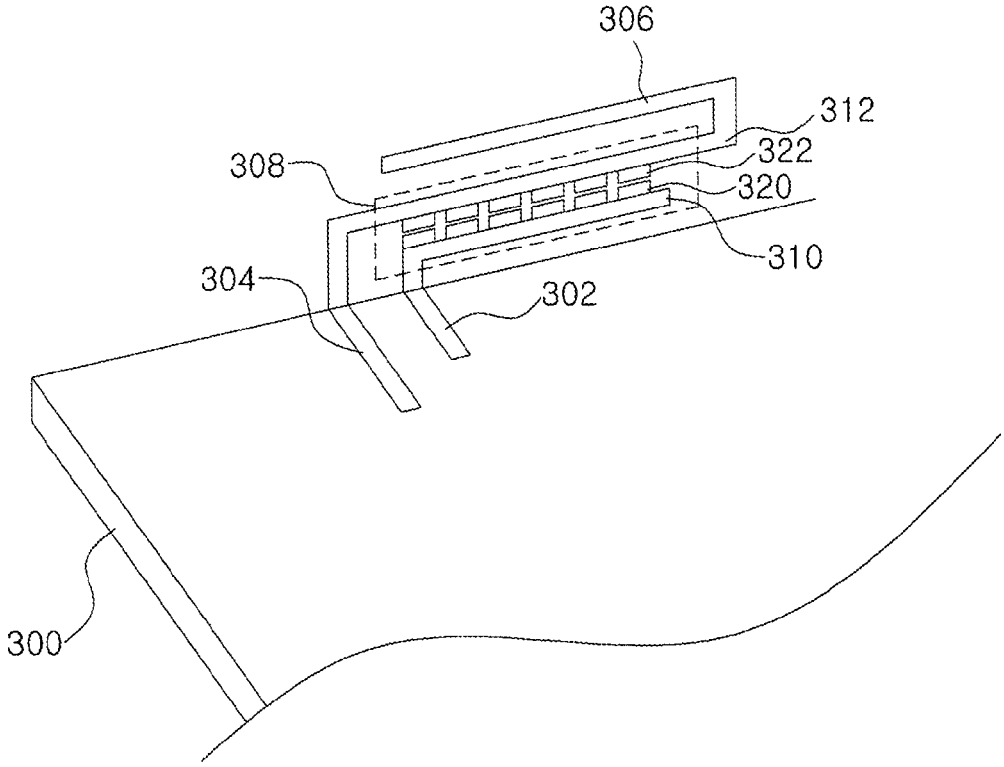
FIG. 3 illustrates a wide-band internal antenna using a slow-wave structure according to an embodiment of the present invention.

FIG. 3 illustrates a wide-band internal antenna using a slow-wave structure according to an embodiment of the present invention.

Referring to FIG. 3, a wide-band internal antenna using a slow-wave structure according to an embodiment of the present invention can include a board 300, a power feed line 302, a short-circuit line 304, a radiator 306, and an impedance matching/power feed part 308.

The board 300 may be made of a dielectric material and may have the power feed line 302 and short-circuit line 304 coupled thereto. Various types of dielectric material can be applied for the board 300, such as a PCB or an FR4 board, etc.

The power feed line 302 may be made of a metallic material and may be electrically coupled with an RF signal transmission line formed on the board of the terminal, to feed RF signals. For example, if the RF signal transmission line is a coaxial cable, the power feed line 302 can be electrically coupled with the conductor inside the coaxial cable.

The short-circuit line 304 may be made of a metallic material and may be electrically connected with a ground.

The radiator 306 may serve to radiate RF signals of preset frequency bands to the exterior and to receive RF signals of preset frequency bands from the exterior. The radiation band may be set according to the length of the radiator 306.

While FIG. 3 illustrates an example in which the radiator has a linear form, the radiator can be shaped in various other known forms, such as of an inverted "L", a meandering form, and rectangular patches, etc.

Referring to FIG. 3, the radiator 306 may extend from the second conductive element 312 of the impedance matching/power feed part 308 and may be fed by coupling.

It is conceivable, in FIG. 3, to have the impedance matching part 308 and the radiator 306 attached to the antenna carrier.

The impedance matching part 308 can include a first conductive element 310 extending from the power feed line 302, a second conductive element 312 extending from the short-circuit line 304, a multiple number of first coupling elements 320 protruding from the first conductive element 310, and a multiple number of second coupling elements 322 protruding from the second conductive element 312.

While FIG. 3 illustrates an example in which the first coupling elements 320 and the second coupling elements 322 are formed as rectangular stubs, the forms of the first coupling elements 320 and second coupling elements 322 are not thus limited, and various other shapes can be employed.

According to a preferred embodiment of the present invention, the first coupling elements 320 and second coupling elements 322 may generally form a slow-wave structure.

Figure 4:
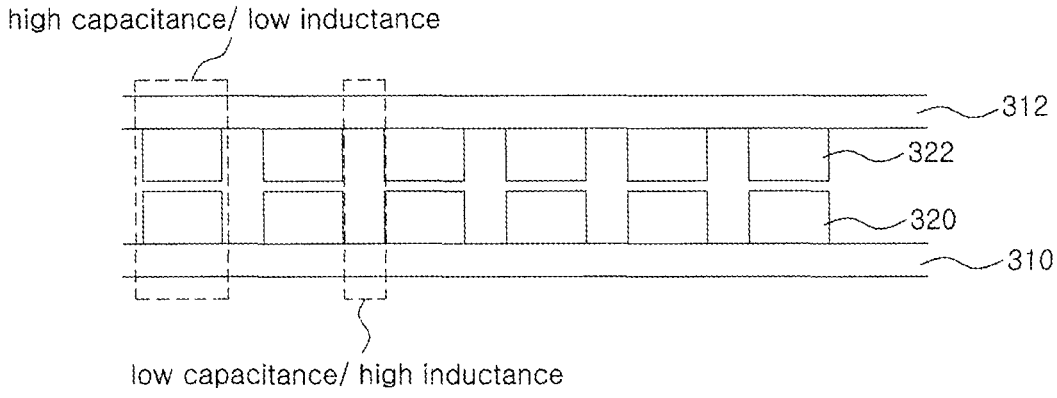
FIG. 4 is a magnified view of an impedance matching part according to an embodiment of the present invention.

FIG. 4 is a magnified view of an impedance matching part according to an embodiment of the present invention.

A slow-wave structure can be implemented by forming a periodic pattern, and FIG. 4 illustrates an example in which the coupling elements protrude in a periodic pattern.

According to a preferred embodiment of the present invention, the slow-wave structure of the impedance matching part may be such that a high capacitance/low inductance structure and a low capacitance/high inductance structure are repeated periodically.

Referring to FIG. 4, the first coupling elements 320 and second coupling elements 322 may be formed in an opposing arrangement. At the portions where the first coupling elements 320 and second coupling elements 322 protrude out, the distance is decreased, so that coupling may be achieved by high capacitance and low inductance components.

At the portions where the first coupling elements 320 and second coupling elements 322 are not formed, the coupling may be achieved by low capacitance and high inductance components.

This configuration of having high capacitance and low capacitance repeated in an alternating manner is intended to maximize the slowing of signals in the slow-wave structure.

As the first conductive element, which is connected with the power feed line, and the second conductive element, which is connected with the short-circuit line, are arranged with a particular distance in-between, traveling waves can be generated in the first conductive element and second conductive element, while the slow-wave structure can slow the progression of the traveling waves.

The slow-wave structure, such as that illustrated in FIG. 4, can reduce the distance between the first coupling elements 320 and second coupling elements 322 and can thus provide high capacitance, so that coupling can be increased, and appropriate radiation can be obtained.

Also, the slow-wave structure such as that illustrated in FIG. 4 can slow the speed of the traveling waves in the impedance matching part, to essentially increase the electrical length of the impedance matching part, so that sufficient coupling can be achieved, and the impedance matching part can be designed to have a smaller size.

Furthermore, if the structure of the impedance matching part is designed as a slow-wave structure, the slowing of signals can be varied according to the frequencies of the travelling waves (the signal slowing effect varies according to frequency). This phenomenon makes it possible to form resonance points for various frequencies, and as a result impedance matching can be provided for a wide band.

Figure 5:
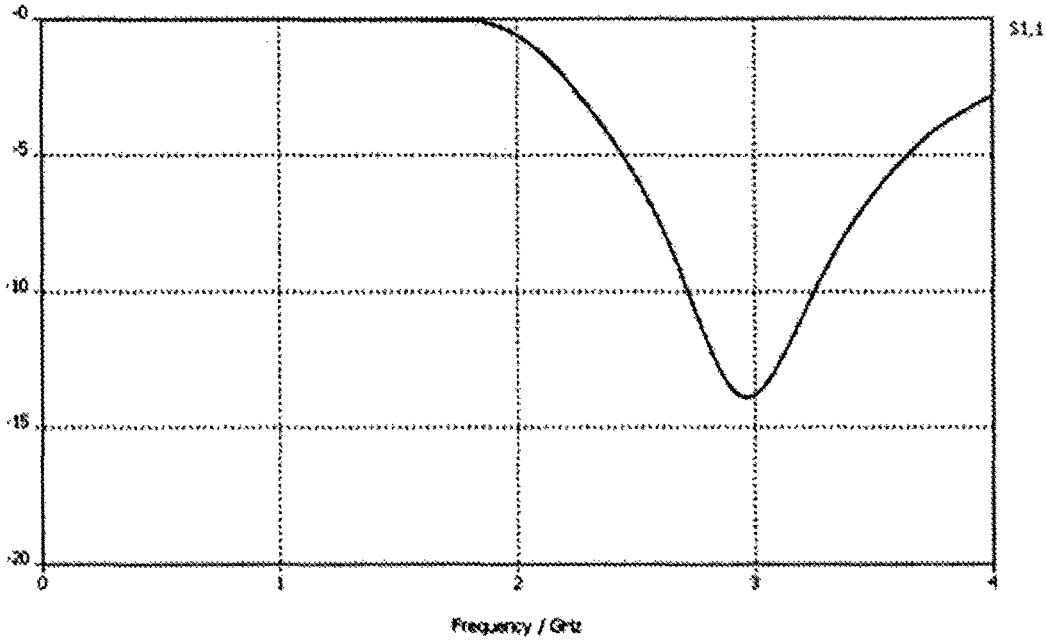
FIG. 5 is a graph representing the reflection loss for the wide-band antenna according to an embodiment of the present invention illustrated in FIG. 4.
Figure 6:
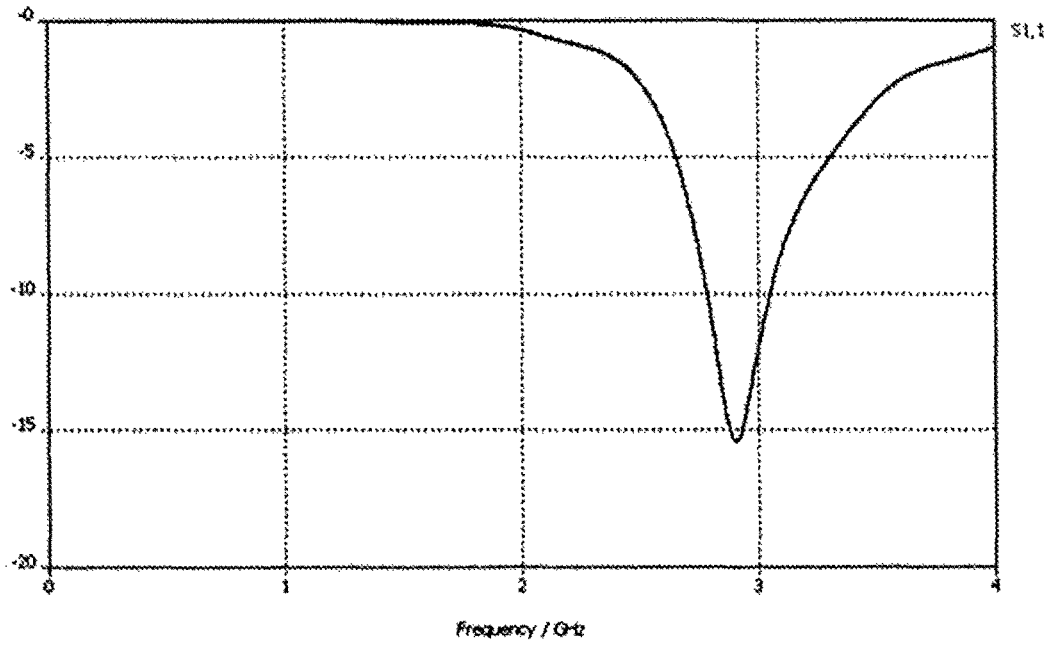
FIG. 6 is a graph representing the reflection loss for a typical inverted-F antenna.

FIG. 5 is a graph representing the reflection loss for the wide-band antenna according to an embodiment of the present invention illustrated in FIG. 4, and FIG. 6 is a graph representing the reflection loss for a typical inverted-F antenna.

Referring to FIG. 5 and FIG. 6, it can be seen that when −10 dB is set as the critical value, impedance matching is provided for a wider band than with the inverted-F antenna.

Figure 7:
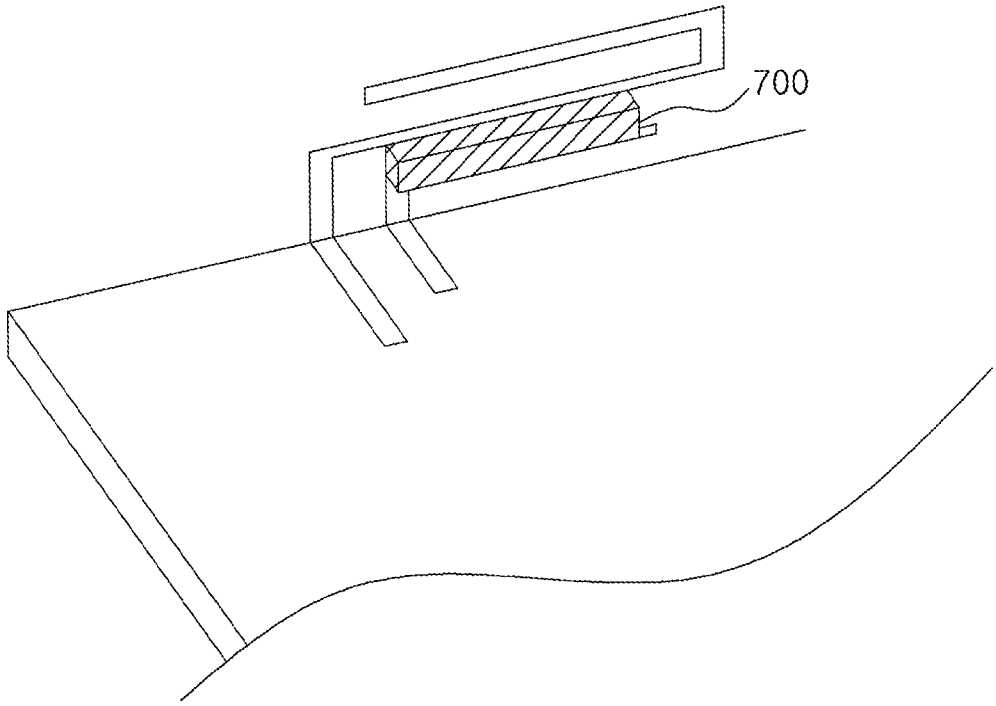
FIG. 7 illustrates the structure of a wide-band antenna using a slow-wave structure according to another embodiment of the present invention.

FIG. 7 illustrates the structure of a wide-band antenna using a slow-wave structure according to another embodiment of the present invention.

Referring to FIG. 7, a dielectric 700 having high permittivity may be coupled to the impedance matching part. Due to its high permittivity, the dielectric 700 enables coupling by a higher capacitance for the coupling matching at the impedance matching part, and the high permittivity can also slow the speed of the travelling waves.

Moreover, when a dielectric having high permittivity is coupled to the impedance matching part, the high capacitance can be utilized to further increase the value of reflection loss. Thus, in environments where high reflection loss is required, an antenna can be used that has a high-permittivity dielectric coupled thereto, as in the example shown in FIG. 7.

Figure 8:
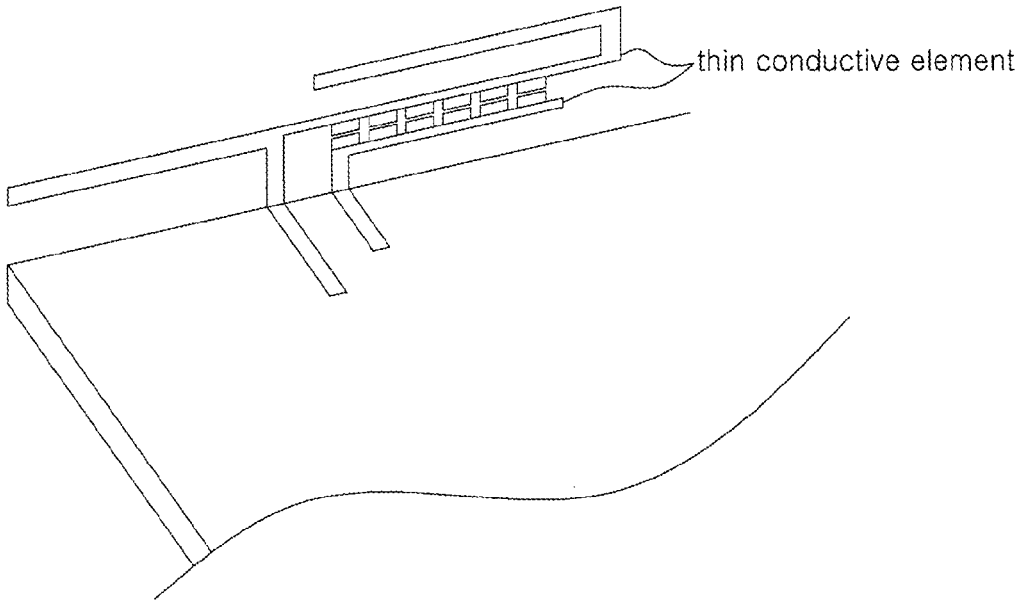
FIG. 8 illustrates the structure of a wide-band antenna using a slow-wave structure according to yet another embodiment of the present invention.

FIG. 8 illustrates the structure of a wide-band antenna using a slow-wave structure according to yet another embodiment of the present invention.

Referring to FIG. 8, it can be seen that the widths of the first conductive member and second conductive member at the impedance matching part are thinner, compared to the antenna illustrated in FIG. 3. The widths of the first conductive member and second conductive member are related to the inductance value, and by adjusting the widths of the first conductive member and second conductive member, it is possible to tune the inductance value related to coupling.

Figure 9:
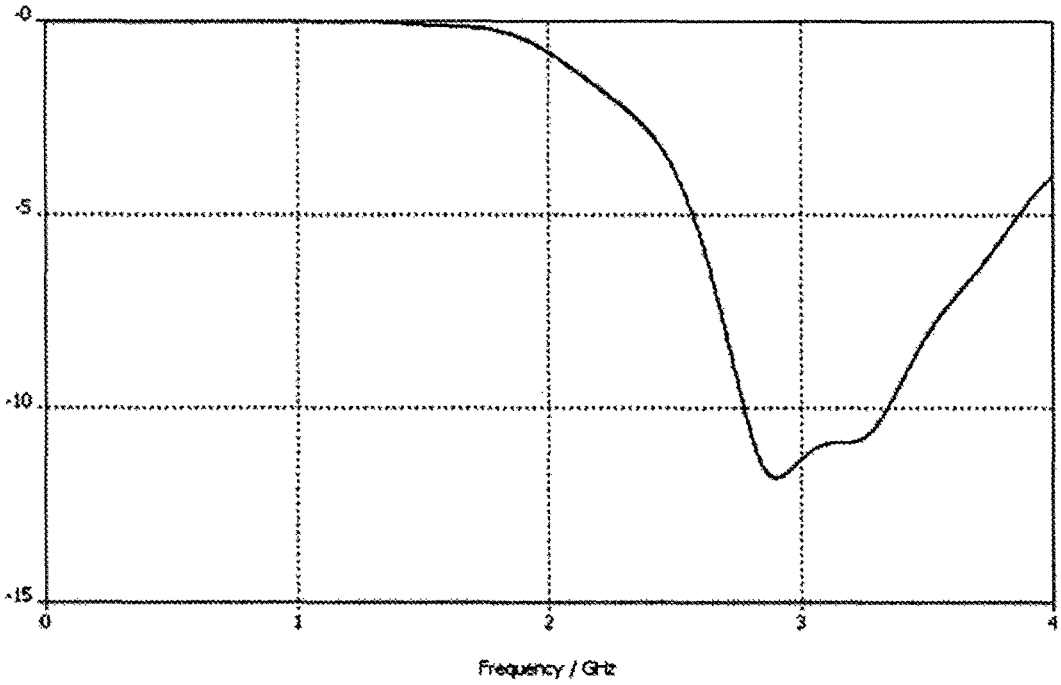
FIG. 9 is a graph representing the reflection loss for the antenna illustrated in FIG. 8.

FIG. 9 is a graph representing the reflection loss for the antenna illustrated in FIG. 8.

As can be seen in FIG. 9, applying thin widths for the first conductive member and second conductive member may improve wide-band characteristics, due to the high inductance component.

Figure 10:
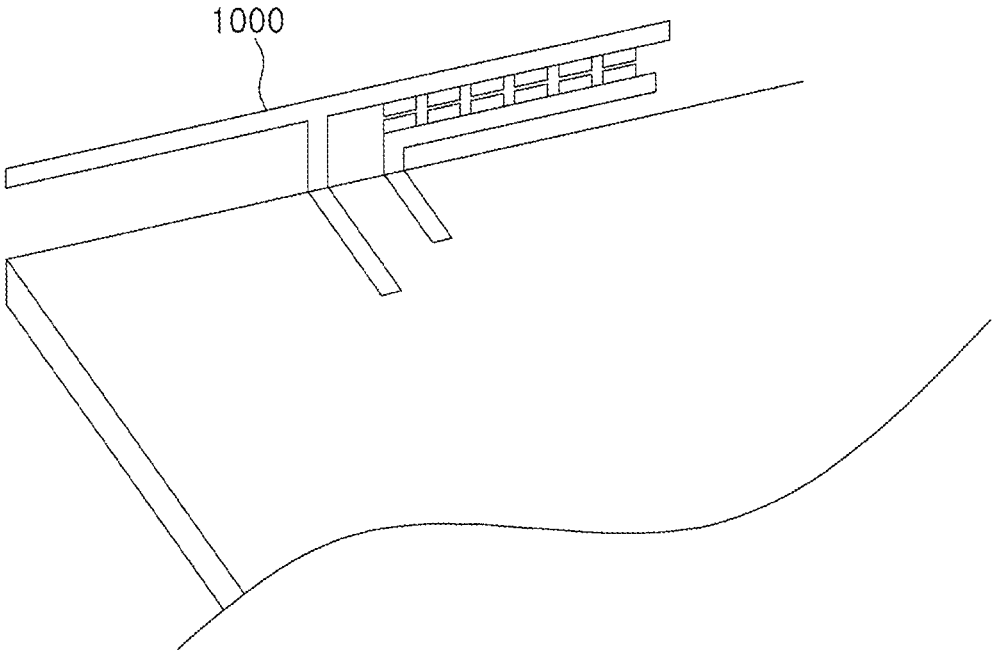
FIG. 10 illustrates the structure of a wide-band antenna using a slow-wave structure according to yet another embodiment of the present invention.

FIG. 10 illustrates the structure of a wide-band antenna using a slow-wave structure according to yet another embodiment of the present invention.

Referring to FIG. 10, two radiators can be used in comparison to the antenna illustrated in FIG. 3, where the second radiator 1000 may extend from another end of the second conductive member.

The invention claimed is:

1. A wide-band internal antenna using a slow-wave structure, the antenna comprising:

an impedance matching/power feed part comprising a first conductive element and a second conductive element, the first conductive element extending from a power feed line, the second conductive element separated by a particular distance from the first conductive element and electrically connected with a ground; and at least one radiator extending from the impedance matching/power feed part, wherein the first conductive element and the second conductive element of the impedance matching/power feed part form a slow-wave structure, and the impedance matching/power feed part forming the slow-wave structure has a plurality of first coupling elements protruding from the first conductive element and has a plurality of second coupling elements protruding from the second conductive element, the first coupling elements and the second coupling elements protruding periodically to form a slow-wave structure.

2. The antenna of claim 1, wherein the first coupling elements and the second coupling elements are formed as rectangular stubs.

3. The antenna of claim 1, wherein the first coupling elements and the second coupling elements forming the slow-wave structure are formed such that a high capacitance/low inductance structure and a low capacitance/high inductance structure are repeated.

4. The antenna of claim 1, wherein a dielectric having high permittivity is coupled to the impedance matching part.

5. The antenna of claim 1, wherein an inductance value related to coupling matching is adjusted by a width of the first conductive element and the second conductive element.

6. A wide-band internal antenna comprising:

a first conductive element electrically coupled with a power feed part;

a second conductive element electrically coupled with a ground and separated by a particular distance from the first conductive part; and at least one radiator extending from the second conductive element to radiate RF signals by coupling power feed, wherein a traveling wave is generated in the first conductive element and the second conductive element, and a periodic slow-wave structure is formed for slowing a progression of the traveling wave.

7. The antenna of claim 6, wherein the slow-wave structure comprises rectangular stubs protruding periodically from the first conductive element and the second conductive element.

8. The antenna of claim 7, wherein the plurality of stubs are formed such that a high capacitance/low inductance structure and a low capacitance/high inductance structure are repeated.

9. The antenna of claim 6, further comprising a dielectric having high permittivity, the dielectric coupled to the first conductive element and the second conductive element.

10. The antenna of claim 6, wherein an inductance value related to coupling matching is adjusted by adjusting a width of the first conductive element and the second conductive element.

* * * * *